US008279084B2

(12) United States Patent
Lee

(10) Patent No.: US 8,279,084 B2
(45) Date of Patent: Oct. 2, 2012

(54) METHOD FOR PROVIDING BUS ARRIVAL TIME FOR PASSENGERS BY USING DSRC

(75) Inventor: Soon Ho Lee, Seoul (KR)

(73) Assignee: KT Corporation (KR)

( * ) Notice: Subject to any disclaimer, the term of this patent is extended or adjusted under 35 U.S.C. 154(b) by 2401 days.

(21) Appl. No.: 10/668,798

(22) Filed: Sep. 23, 2003

(65) Prior Publication Data

US 2004/0122884 A1 Jun. 24, 2004

(30) Foreign Application Priority Data

Sep. 24, 1920 (KR) ..... 10-2002-0057766

(51) Int. Cl.
*G08G 1/09* (2006.01)

(52) U.S. Cl. ..... 340/905; 340/994

(58) Field of Classification Search ..... 340/994, 340/904, 988, 989, 991, 905
See application file for complete search history.

(56) References Cited

U.S. PATENT DOCUMENTS

| | | | | |
|---|---|---|---|---|
| 3,644,883 | A * | 2/1972 | Borman et al. | 340/991 |
| 5,623,260 | A * | 4/1997 | Jones | 340/994 |
| 5,739,774 | A * | 4/1998 | Olandesi | 340/994 |
| 6,006,159 | A * | 12/1999 | Schmier et al. | 701/200 |
| 6,803,862 | B2 * | 10/2004 | O'Connor et al. | 340/994 |

FOREIGN PATENT DOCUMENTS

| | | | |
|---|---|---|---|
| CN | 1147118 | A | 4/1997 |
| JP | 54082584 | A * | 6/1979 |
| JP | 11-191197 | A | 7/1999 |
| JP | 11-399190 | | 12/1999 |
| JP | 2000-285368 | | 10/2000 |
| JP | 2002-203299 | | 9/2002 |
| JP | 2002-251697 | | 9/2002 |
| KR | 1020000067765 | A | 11/2000 |
| KR | 1020010100954 | A | 11/2001 |
| KR | 1020020016184 | A | 3/2002 |
| KR | 1020020045793 | | 6/2002 |

* cited by examiner

*Primary Examiner* — Travis Hunnings
(74) *Attorney, Agent, or Firm* — Blakely, Sokoloff, Taylor & Zafman

(57) ABSTRACT

A method for providing an expected arrival time of bus stops or major bus stops to bus passengers is disclosed. The method includes the steps of: a) collecting traffic information including a on-board device ID, a roadside base station ID and a pass time from the roadside base station; b) computing an average traffic speed of each section based on the collected traffic information and computing time required for arriving to each bus stop from a roadside base station based on the computed average traffic speed of each section; and c) at the bus information server, transmitting the computed time required for arriving to each bus stop from the roadside base station in order to expected arrival time of each bus station and time required for arriving at each bus stop through a display device to passengers of a bus by using the roadside base station and on-board device.

7 Claims, 4 Drawing Sheets

FIG. 4

| ROADSIDE BASE STATION ID : R1 | BUS STOP | TIME REQUIREMENT |
|---|---|---|
| ON-BOARD GROUP ID | S1 | 90 SEC |
| | S2 | 270 SEC |
| | S3 | 525 SEC |

| ROADSIDE BASE STATION ID : R2 | BUS STOP | TIME REQUIREMENT |
|---|---|---|
| ON-BOARD GROUP ID | S2 | 163 SEC |
| | S3 | 310 SEC |
| | S4 | 550 SEC |

METHOD FOR PROVIDING BUS ARRIVAL TIME FOR PASSENGERS BY USING DSRC

FIELD OF THE INVENTION

The present invention relates to an intelligent transport system (ITS) using a dedicated short range communication (DSRC); and, more particularly, to a method for providing desired information such as an expected arrival time of bus stops or major bus stops to bus passengers by using the ITS with DSRC and a computer readable recoding medium for executing the same method.

DESCRIPTION OF RELATED ARTS

Generally, a dedicated short range communication DSRC is two way short range communication between a communication device installed at each bus stop and on-board communication device installed in a bus. Hereinafter, the communication device installed at each bus stop is a bus stop base station and the on-board communication device in a bus is an on-board device. The DSRC has been developed for automatically collecting a bus fare and it has been applied to various fields of an intelligent transport system (ITS) based on it's high speed two way communication. For example, the ITS using DSRC is used for collecting traffic information of interested roadway and providing the collected traffic information to passengers.

In a prior art, an electric display device is equipped in the bus and News or multimedia information is provided to the passengers through the electric display device by downloading related information data from information provider through a mobile communication network or a satellite communication network. However, it does not provide arrival time of desired bus stop which is most valuable information to the passengers.

In another prior art, a bus information server provides traffic information of desired road way including average speed of traffic flow of desired roadway to the on-board device in a vehicle and the on-board device computes expected arrival time for each bus stop. However, it requires various functions to the on-board device since the on-board device needs to compute expected arrival time based on the received traffic information from the bus information server, which increases complexity of the on-board device. Therefore, the above mentioned disadvantages of the prior art increase cost of system including on-board device. Furthermore, it is difficult to manage the on-board device since information stored an each on-board device needs to be modified when a course of bus in changed.

SUMMARY OF THE INVENTION

It is, therefore, an object of the present invention to provide a method for providing desired information including an expected arrival time of each bus stop to passengers by receiving the desired information from a bus information server, wherein the bus information server collects information including an on-board device ID, a roadside base station ID and a time of passing each roadside base stations, computes average traffic speeds of sections between adjacent bus stops and computes the expected arrival time from the roadside base station to the bus stops.

It is another object of the present invention to provide a computer readable recoding medium for executing a method for providing desired information including an expected arrival time of bus stops to passengers by receiving the desired information from a bus information server, wherein the bus information server collects information including an on-board device ID, a roadside base station ID and a time of passing each roadside base stations, computes average traffic speeds of sections between adjacent bus stops and computes the expected arrival time from the roadside base station to the bus stops.

In accordance with an aspect of the present invention, there is provided a method for providing an expected arrival time of bus stops for a traffic information system, wherein the traffic information system includes an on-board device, a plurality of roadside base stations and a bus information server, the method including the steps of: a) collecting traffic information including a on-board device ID, a roadside base station ID and a pass time from the roadside base station; b) computing an average traffic speed of each section based on the collected traffic information and computing time required for arriving to each bus stop from a roadside base station based on the computed average traffic speed of each section; and c) at the bus information server, transmitting the computed time required for arriving to each bus stop from the roadside base station in order to expected arrival time of each bus station and time required for arriving at each bus stop through a display device to passengers of a bus by using the roadside base station and on-board device.

In accordance with another aspect of the present invention, there is also provided a method for providing an expected arrival time of bus stops for a traffic information system, wherein the traffic information system includes an on-board device, a plurality of roadside base stations and a bus information server, the method including the steps of: a) at the on-board device, transmitting on-board device ID to a roadside base station through a dedicated short range communication protocol; b)at the on-board device, receiving an arrival time of each bus stop stored in the roadside base station according to the on-board ID, wherein the arrival time of each bus stop is computed at the bus information server according to the on-board group ID; and c) announcing the arrival time of each bus stop through an output device of the on-board device.

In accordance with still another aspect of the present invention, there is also provided a computer readable recoding medium for storing a program for executing a method for providing an expected arrival time of bus stops for a traffic information system, wherein the traffic information system includes an on-board device, a plurality of roadside base stations and a bus information server, the method including the steps of: a) collecting traffic information including a on-board device ID, a roadside base station ID and a pass time from the roadside base station; b) computing an average traffic speed of each section based on the collected traffic information and computing time required for arriving to each bus stop from a roadside base station based on the computed average traffic speed of each section; and c) at the bus information server, transmitting the computed time required for arriving to each bus stop from the roadside base station in order to expected arrival time of each bus station and time required for arriving at each bus stop through a display device to passengers of a bus by using the roadside base station and on-board device.

In accordance with further still another aspect of the present invention, there is also provided a computer readable recoding medium for storing a program for executing a method for providing an expected arrival time of bus stops for a traffic information system, wherein the traffic information system includes an on-board device, a plurality of roadside base stations and a bus information server, the method including the steps of: a) at the on-board device, transmitting on-board device ID to a roadside base station through a dedicated short range communication protocol; b)at the on-board device, receiving an arrival time of each bus stop stored in the roadside base station according to the on-board ID, wherein the arrival time of each bus stop is computed at the bus information server according to the on-board group ID; and c) announcing the arrival time of each bus stop through an output device of the on-board device.

BRIEF DESCRIPTION OF THE DRAWING(S)

The above and other objects and features of the present invention will become apparent from the following description of the preferred embodiments given in conjunction with the accompanying drawings, in which.

Figure 3:
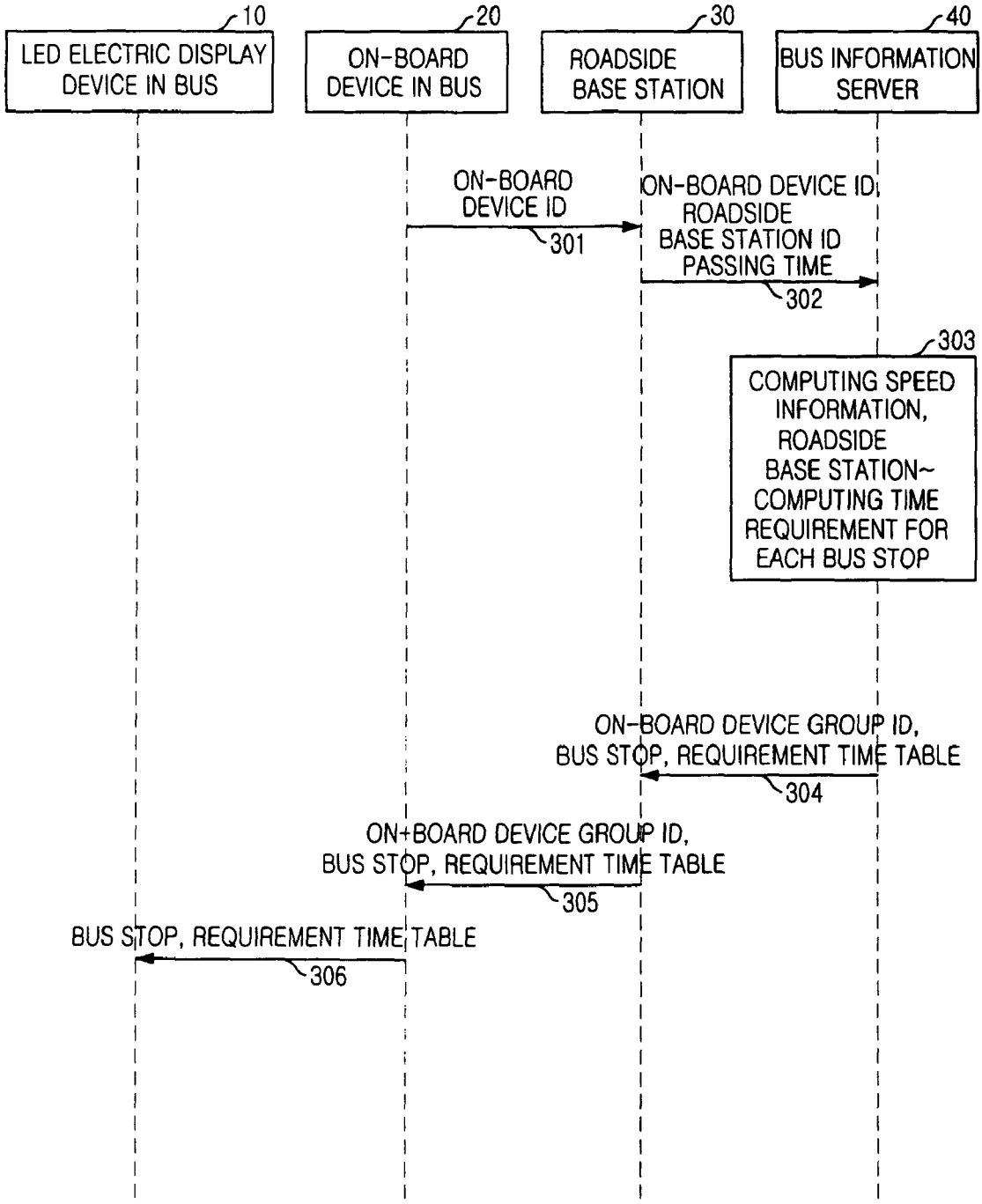

FIG. 3 is a flowchart for explaining a method for providing information including arrival time of bus stop in accordance with a preferred embodiment of the present invention; and FIG. 4 shows a data table stored a database in a bus information server, wherein the data table containing computed an expected time required for arriving to each bus stop according to an on-board device group ID, bus stops of roadside base stations or major bus stops in accordance with the present invention.

DETAILED DESCRIPTION OF THE INVENTION

Other objects and aspects of the invention will become apparent from the following description of the embodiments with reference to the accompanying drawings, which is set forth hereinafter.

Figure 1:
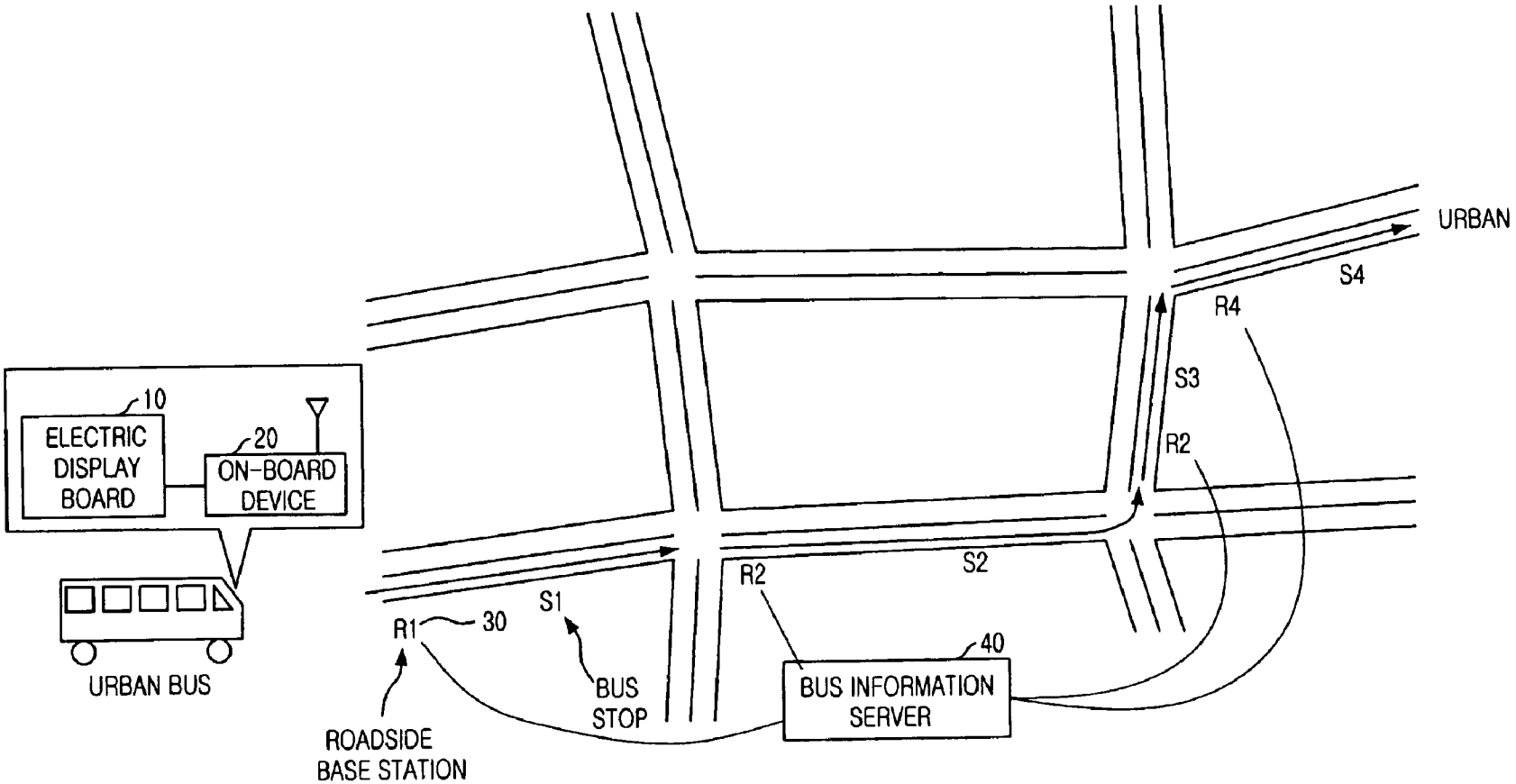
FIG. 1 is a diagram for illustrating a system for providing information including an expected arrival time of bus stop by using dedicated short range communication in accordance with a preferred embodiment of the present invention.

FIG. 1 is a diagram for illustrating a system for providing information including an expected arrival time of bus stop by using dedicated short range communication in accordance with a preferred embodiment of the present invention.

Referring to FIG. 1, the system includes an electric display device 10, an on-board device 20, a plurality of roadside base stations 30 R1 to R4 and a bus information server 40.

The electric display device 10 is installed in the bus. The electric display device 10 is installed at upper portion of the back side of driver seat or a ceiling in forwarding to the passengers. The electric display device 10 receives desired information including an expected arrival time from the on-board device 20 and displays the desired information for passengers in the bus.

The on-board device 20 is also installed in the bus. The on-board device 20 transmits its own on-board device ID to corresponding roadside base station whenever the bus passes the roadside base station. Also the on-board device 20 receives traffic information including the expected arrival time of each bus stop or the time required for arriving at each bus stop from the roadside base station.

A plurality of roadside base stations 30 R1 to R4 receives the on-board device ID from the on-board device and transmits a pass time which is a time passing the bus equipped the on-board device, the received on-board device ID and own roadside base station ID to the bus information server 40. A plurality of roadside base station 30 also receives a time required for arriving at each bus stop from the corresponding roadside base station and an expected arrival time of each bus stop. A plurality of roadside base station 30 transmits information including the time required for arriving at each bus stop and expected arrival time of each bus stop to the on-board device whenever the bus having the on-board device passes corresponding roadside base station 30.

The bus information server receives the information including the pass time, the on-board device ID and the roadside base station ID from a plurality of roadside base stations 30 R1 to R4. The bus information server computes an average traffic speed of each section between bus stops based on the received information. The bus information server also computes a time required for arriving to each bus stop and an expected arrival time of each bus stop from a plurality of roadside base stations. The computed values are stored in a database in the bus information server as a form of table. The bus information server transmits the table with computed values to corresponding on-board device for announcing the time required for arriving at each bus stop or major stops or the arrival time of each bus stop to the passengers of the bus.

Referring to FIG. 1, a method for collecting traffic information of each section between bus stops is explained hereinafter.

When a bus equipping an electric display device 10 and an on-board device 20 is passed by one of roadside base stations 30 R1~R4, the on-board device 20 transmits the on-board device ID to corresponding roadside base station 30. The roadside base station 30 receives the transmitted on-board device ID and transmits the received on-board device ID, own roadside base station ID and a pass time to a bus information server 40. As a result, the bus information server 40 collects traffic information containing that a list of buses passing each roadside base station. The bus information server 40 computes traffic speed of each section between bus stops based on the collected information.

Referring to FIG. 1, a method for providing a time required for arriving at each bus stop is explained hereinafter.

The bus information server 40 computes average traffic speed of each section between bus stops based on received information from the roadside base station and previously computed traffic speed stored in the database. After computing the average traffic speed, the bus information server 40 computes the time required for arriving at each bus stop from the roadside base station. The computed time required for arriving at each bus stop from the roadside base station is transmitted to the corresponding roadside base station. For example, the bus information server computes expected times for traveling section of R1~S1, R1~S2 and R1~S3 and transmits the expected times for traveling to the roadside base station R1. The roadside base station R1 transmits corresponding data table containing the expected times for traveling sections to the on-board device when the bus passes the roadside base station R1. The on-board device 20 displays information received from the roadside base station R1 to provide time required for arriving at each bus stop from the roadside base station R1 and the expected arrival time of each bus stop to the passengers of the bus.

Figure 2:
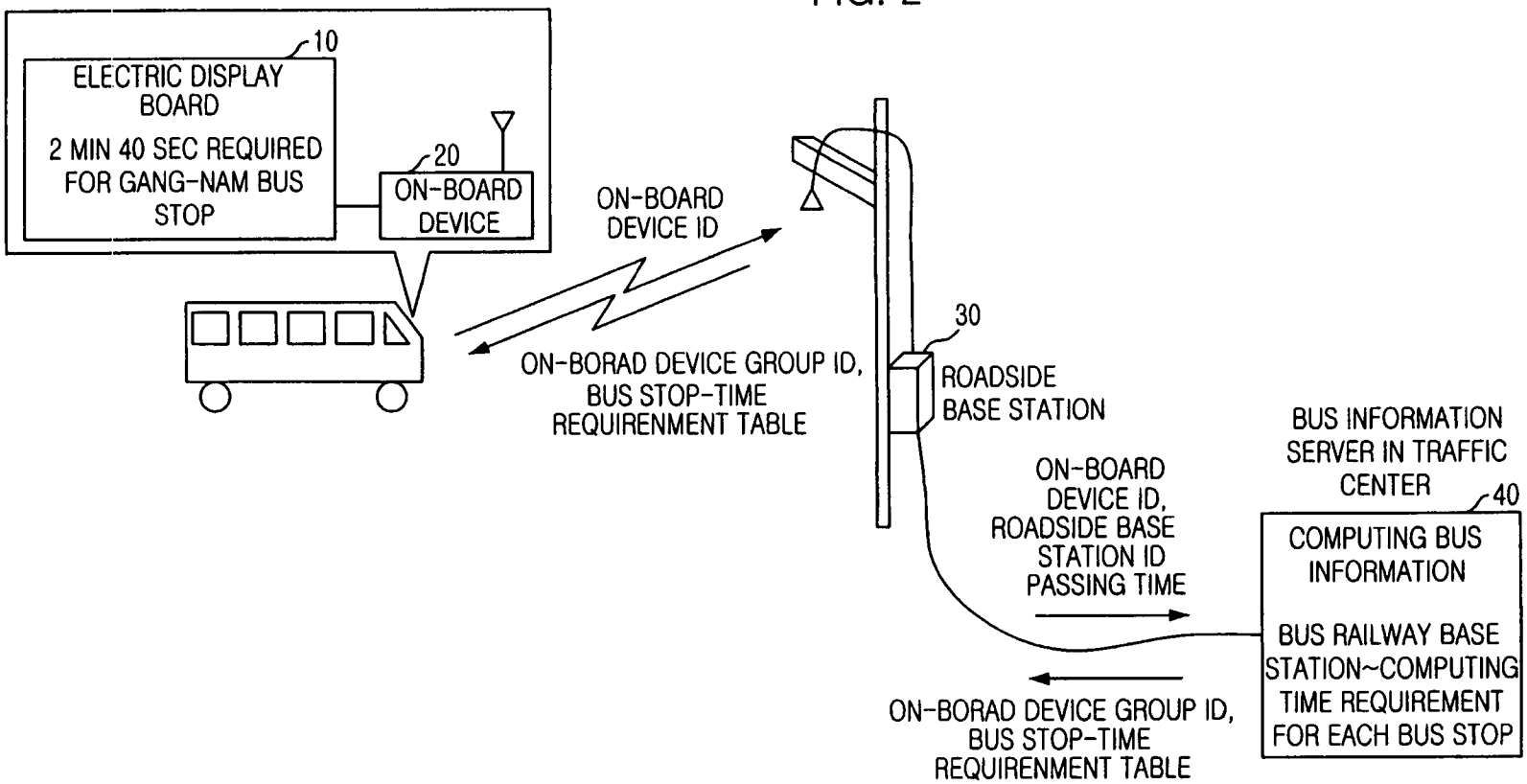
FIG. 2 is a detailed diagram for illustrating a system for providing information including expected arrival times of bus stops by using dedicated short range communication in accordance with a preferred embodiment of the present invention.

FIG. 2 is a detailed diagram for illustrating a system for providing information including expected arrival times of bus stops by using dedicated short range communication in accordance with a preferred embodiment of the present invention.

Referring to FIG. 2, a supporting structure such as a poll for the roadside base station is installed at side of roadway. The roadside base station is attached to the supporting structure and also antenna unit and a RF unit of the roadside base station are attached to the supporting structure because of obtaining a line of sight for wireless communication. The on-board device 20 is installed at an upper part of driver side front glass of the bus for obtaining maximum line of sight in order to communicate to the roadside base station. The electric display device 10 is installed at upper portion of the back side of driver seat or a ceiling in forwarding to the passengers. The roadside base station 30 and the bus information server are connected through a dedicated line or a wired network such as xDSL or ADSL. Also, a wireless network such as TRS or wireless data network can be used for the connection between the roadside base station 30 and the bus information server 40.

FIG. 3 is a flowchart for explaining a method for providing information including expected arrival times of bus stops and time required for arriving to bus stops from corresponding roadside base station in accordance with a preferred embodiment of the present invention.

Referring to FIG. 3, at step 301, an on-board device 20 transmits an on-board device ID to a roadside base station when a bus enters a communication range of the roadside base station 30. At step 302, the roadside base station 30 transmits the on-board base station ID, the roadside base station ID and a pass time which is a time passing the corresponding roadside base station to the bus information server 40. That is, the roadside base station 30 which installed at the supporting structure on the roadway receives the on-board device ID from the on-board device in the bus when the bus passes the roadside base station. After receiving the on-board device ID, the roadside base station 30 transmits the received on-board device ID, the roadside base station ID and the pass time to the bus information server 40.

The bus information server 40 computes an average traffic speed of each section between the bus stops and computes a time required for traveling each section between bus stops from the corresponding roadside base station based on the computed average traffic speed of each section at step 303. That is, the bus information server 40 computes traffic speed of each section between the roadside base stations based on the received on-board device ID, roadside base station ID and pass times, and stores the computed traffic speed of each section in a section-speed_DB as a form of table. The average traffic speed of each section is re-computed and updated based on the traffic speed of each section previously stored in the section-speed_DB and newly computed traffic speed of each section. After computing the average traffic speed of each section, the bus information server 40 computes a time required for arriving at each bus stop from the corresponding roadside base station by reading a bus-stop_DB. The bus-stop_DB stores tables containing a list of major bus stops according to an on-board group ID. The on-board group ID is identification for a list of buses passing corresponding roadside base station. A course of bus passing corresponding roadside base station is determined by the on-board device group ID. The newly computed times required for arriving at each bus stop from the corresponding roadside base station are stored in a requirement time_DB. By updating newly computed time required for arriving at the bus stops, the exact arrival time or time required for arriving at the bus stop can be calculated although a traffic situation is rapidly varied.

At step 304, the bus information server 40 transmits computed time required for arriving at bus stops or major bus stops to the corresponding roadside base station. That is, the bus information server 40 transmits a data table of the requirement time_DB and the on-board device ID to the roadside base station.

At step 305, the roadside base station 30 transmits the expected arrival time for each bus stop and the time required for arriving at bus stops to the on-board device 20 of the urban bus. That is, the roadside base station 30 transmits corresponding on-board device group ID of corresponding bus and the table containing arrival times to the on-board device 20 and times required for arriving at bus stops when the roadside base station 30 receives the on-board device ID.

At stop of 306, the on-board device 20 announces the arrival times of each bus stop and the times required for arriving at bus stops by displaying corresponding information on the electric display device equipped in the bus. That is, when the on-board device 20 receives the data table containing arrival times of each bus stop and time required for arriving at bus stops from the roadside base station, the electric display device, a LED display device or a speaker announce the information including the arrival time of each bus stop and time required for arriving at bus stops to the passengers.

In the above mentioned method, since the bus information server 40 already computes traffic information and times required for arriving at bus stops of previously passing buses and the roadside base station 30 already stores information including the time required for arriving at each bus stop and the on-board device group ID, an on-board device 20 of a bus currently passing corresponding roadside base station receives a table containing time required for arriving at each bus stop and corresponding on-board device group ID as soon as the on-board device transmits own on-board device ID to the roadside base station.

In a meantime, since the bus-stop_DB and section speed_DB are well know to ordinary one skilled in the art, detailed explanation of implementation of the bus-stop_DB and section speed_DB is omitted. A requirement time_DB is explained in detail hereinafter.

FIG. 4 shows a data table, which is stored in a bus information server, containing time required for arriving at bus stops or major bus stops in accordance with a preferred embodiment of the present invention.

Referring to FIG. 4, the roadside base station 30 stores a time table having times required for arriving at each bus stop according to a course of bus which passes the corresponding roadside base station 30 and provides the time table to the corresponding bus. Since it is convenient to search information according to the on-board device group ID when the roadside base station provides the time table, the on-board device group ID of identical course is pre-determined according to buses of identical course. Also, the bus information server 40 can efficiently provide information such as expected time required for arriving at each bus stop by selecting major bus stops among all bus stops and providing information for only major bus stops to the passengers.

The above mentioned present invention can be implemented as a program and can be stored in a computer readable recording medium such as a floppy disk, a hard disk, a CD_ROM, a ROM, a RAM and an optical magnetic disk.

As mentioned above, the present invention can decrease complexity of on-board device that provides desired information such as an expected arrival time or expected time required for arriving at each bus stop to the passengers of the bus and also provides a convenient way of managing the on-board device.

Also, the present invention can provide convenient way of announcing desired information such as expected arrival time or time required for arriving at bus stops by selecting major bus stops among all bus stops and providing selected information according to the major bus stops.

Furthermore, the present invention can efficiently manage information by building a data table according to courses of the bus and roadside base station and storing the data table in the bus information server.

Moreover, the present invention provides a way to react according to current traffic situation such as transferring to subway for keeping appointment by providing real-time expected arrival time of each bus stop or time required for arriving at each bus stop.

While the present invention has been described with respect to certain preferred embodiments, it will be apparent to those skilled in the art that various changes and modifications may be made without departing from the scope of the invention as defined in the following claims.

What is claimed is:

1. A method for providing an expected arrival time of bus stops for a traffic information system, wherein the traffic information system includes an on-board device, a plurality of roadside base stations and a bus information server, the method comprising the steps of:

a) at one of the roadside base stations which are installed at side of roadway between the bus stops, receiving an on-board device ID from the on-board device in a bus, when the bus equipping the on-board device passes the roadside base station without stopping;

b) at the roadside base station, transmitting traffic information including the on-board device ID, a roadside base station ID and a pass time to the bus information server;

c) at the bus information server, computing a traffic speed of each section between the roadside base stations using the traffic information;

d) at the bus information server, computing an average traffic speed of each section between the roadside base stations using the computed traffic speed of each section;

e) at the bus information server, computing time required for arriving at next bus stops from the roadside base station based on the computed average traffic speed of each section;

f) at the bus information server, transmitting the computed time required for arriving at each of the next bus stops from the corresponding roadside base station g) at the roadside base station, transmitting the computed time required for arriving at each of the next bus stops to the on-board device when the roadside base station receives the on-board device ID; and h) at the on-board device, announcing the expected arrival time of each of the next bus stops based on the computed time required for arriving through an output device.

2. The method as recited in the claim 1, wherein the bus information server, the roadside base station and the on-board device determine a bus course based on an on-board device group ID.

3. The method as recited in the claim 1, wherein the bus stops are major bus stops.

4. The method as recited in claim 1, wherein in the step c), the bus information server stores the computed traffic speed of each section to a section speed_DB.

5. The method as recited in claim 4, wherein in the step d), the bus information server updates the average traffic speed of each section based on the computed traffic speed of each section previously stored in the section speed_DB.

6. The method as recited in claim 5, wherein the step e) includes the steps of:

e1) reading a bus stop_DB stored in the bus information server as a form of a table containing a bus stop list according to bus courses passing the roadside base station;

e2) computing the time required for arriving at each of the bus stops based on the table of the bus stop_DB; and e3) storing the computed time for arriving at each of the bus stops in a requirement time_DB as a form of a table.

7. The method as recited in claim 6, wherein in the step f), the bus information server transmits the table of the requirement time_DB and an on-board device group ID to the corresponding roadside base station.

* * * * *